US009693620B2

(12) United States Patent
Donahue

(10) Patent No.: US 9,693,620 B2
(45) Date of Patent: Jul. 4, 2017

(54) CUSTOMIZABLE BACKPACK AND METHODS OF USE

(71) Applicant: Chad Donahue, Erie, CO (US)

(72) Inventor: Chad Donahue, Erie, CO (US)

( * ) Notice: Subject to any disclaimer, the term of this patent is extended or adjusted under 35 U.S.C. 154(b) by 0 days.

(21) Appl. No.: 15/228,144

(22) Filed: Aug. 4, 2016

(65) Prior Publication Data

US 2016/0338472 A1 Nov. 24, 2016

Related U.S. Application Data

(63) Continuation of application No. 14/705,220, filed on May 6, 2015, now Pat. No. 9,433,278.

(60) Provisional application No. 61/990,208, filed on May 8, 2014.

(51) Int. Cl.

| | |
|---|---|
| ***A45C 3/04*** | (2006.01) |
| ***A45F 3/04*** | (2006.01) |
| *A45C 3/08* | (2006.01) |
| *A45C 13/08* | (2006.01) |
| *A45F 3/00* | (2006.01) |
| *A45C 13/02* | (2006.01) |

(52) U.S. Cl.

CPC ..... *A45F 3/04* (2013.01); *A45F 3/042* (2013.01); *A45C 3/08* (2013.01); *A45C 13/02* (2013.01); *A45C 13/08* (2013.01); *A45F 2003/001* (2013.01)

(58) Field of Classification Search

CPC ..... A45C 3/08; A45C 13/08; A45C 13/02; A45C 7/0086; A45F 3/04; A45F 3/042; A45F 2003/001

See application file for complete search history.

(56) References Cited

U.S. PATENT DOCUMENTS

| | | | | |
|---|---|---|---|---|
| 5,533,558 | A * | 7/1996 | Carey | A45C 3/08 150/105 |
| 6,173,837 | B1 * | 1/2001 | Marconi | A45C 3/08 190/125 |
| 6,230,952 | B1 * | 5/2001 | Jupiter | A45F 3/04 150/113 |
| 2010/0078099 | A1 * | 4/2010 | Armstrong | A45C 3/08 150/105 |
| 2012/0241059 | A1 * | 9/2012 | Wilson | A45C 3/08 150/105 |
| 2013/0032502 | A1 * | 2/2013 | Anderson | A45C 13/00 206/457 |

(Continued)

*Primary Examiner* — Corey Skurdal

(74) *Attorney, Agent, or Firm* — Leyendecker & Lemire, LLC

(57) ABSTRACT

A customizable backpack and method of use is described. Embodiments of the customizable backpack can include a pack body, a pack flap, a first panel, and a second panel. The first panel can be coupled to the pack body via the pack flap and the second panel can be removably attached to the first panel. One or more fastening mechanisms can be implemented to couple the first panel to the pack flap. Decorative objects can be removably attached to the first panel and to the second panel to customize the backpack. In a typical implementation, a user can decorate the first panel and the second panel with one or more decorative objects and/or utilitarian objects. The user can then decide which side of the first panel or the second panel to face outwardly when wearing the backpack.

9 Claims, 7 Drawing Sheets

(56) References Cited

U.S. PATENT DOCUMENTS

| | | | | |
|---|---|---|---|---|
| 2013/0306206 | A1* | 11/2013 | Quinnan | A45C 13/08<br>150/105 |
| 2015/0192387 | A1* | 7/2015 | Thompson | F41C 33/0263<br>224/243 |
| 2015/0289629 | A1* | 10/2015 | Nakamura | A45F 3/04<br>36/136 |

* cited by examiner

CUSTOMIZABLE BACKPACK AND METHODS OF USE

CROSS-REFERENCE TO RELATED APPLICATION

This application is a continuation of U.S. patent application Ser. No. 14/705,220, filed May 6, 2015.

This application claims the benefit of U.S. Provisional Application No. 61/990,208, filed May 8, 2014.

BACKGROUND

Backpacks and messenger bags, as well as many other bag designs, are configured to be carried by a user to transport articles contained therein and often include an outwardly-facing flap (back flap). The back flap is fixed to, and typically integral to, the bag and is not removable. The design of the back flap including, but not limited to, color, patterns, features, etc. are not changeable and do not permit a user to customize or modify his/her bag.

Currently, to customize a backpack, users must use permanent means of customization to modify the backpack. For example, users will typically write on a backpack with marker or attach patches to the backpack by sewing them into fabric of the backpack. As such, the user can customize the backpack, but must anticipate using their customizations for long periods of time before switching to a new backpack if they no longer like the look of their customizations. Further, storage compartments of conventional backpacks are either bare or include one or more pockets permanently placed inside the storage compartment. As such, a user is stuck with the design choices of the backpack manufacturer.

A bag including a customizable flap, that is removable and provides a plurality of display options, and a customizable storage compartment is needed.

DETAILED DESCRIPTION

Figure 1:
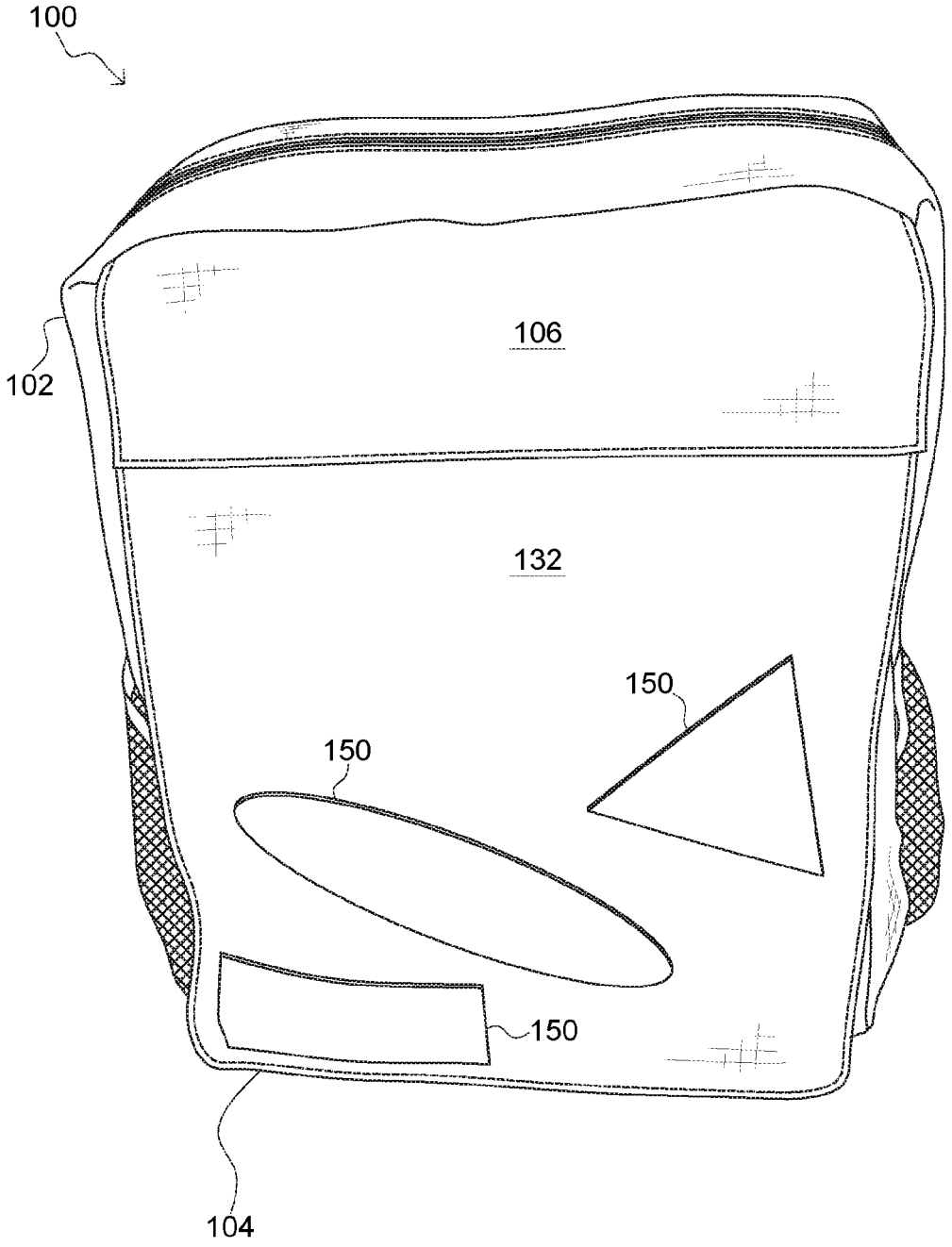
FIG. 1 is a back view of a customizable backpack according to one embodiment of the present invention.

Embodiments of the present invention include a backpack having a customizable back flap. Generally, the back flap can have a first panel and a second panel. The panels can be sized to substantially cover an entire back side of a body of the backpack. Typically, each panel can include a first side and a second side. In one embodiment, the first side and the second side of the first panel can both be covered in a loop-type material. In another embodiment, the first side of the first panel can be covered in a loop-type material and the second side can be covered in a fabric. Generally, the second panel can be adapted to couple to the first panel and can be comprised of fabric.

Typically, a user can be able to select from three different panel surfaces to face outwardly when wearing the customizable backpack. For instance, the customizable backpack can be adapted to have the first side of the first panel outwardly facing, the second side of the first panel outwardly facing, or the first side of the second panel outwardly facing.

The first panel can allow a user to affix design and utility objects having complimentary hook elements to the loop surface. The design and utility objects can include, but are not limited to, fabric sheets or plastic sheets having graphical elements associated therewith to change a look of the backpack. In some instances, the objects can include, but are not limited to, patches, badges, and stickers that can be arranged on the first side of the panel to create a collage as desired and arranged by the user. The objects can be utilitarian in nature including, but not limited to, pockets, reflectors, dry erase boards, containers, pouches, and toy holders.

Embodiments of the present invention including the first panel with loop material covering both surfaces can offer several advantages. For instance, a user can have the ability to not only secure objects to an exterior surface of the panel, but the user can also secure objects to the interior surface as well. In some configurations, for instance, a user may want to install some utilitarian objects on the interior surface of the panel. For example, a user may wish to attach a cell phone pocket, a pencil/pen holder, and/or a tablet case while at the same time displaying aesthetic graphical objects on the outer surface. In yet another variation, a user may have different aesthetic objects attached to both surfaces so that they can simply flip the panel on the backpack and change the look immediately.

In an embodiment implementing the second panel comprising fabric, the fabric of the second panel can generally be manufactured to have the same color as the backpack. It is to be appreciated that the second panel can be comprised of fabric having any color and/or pattern to further personalize the customizable backpack. Stickers can be adhesively affixed to the fabric second panel. In one instance of the second panel, the second panel can be comprised of a polyester fabric. The polyester fabric can be implemented to allow users to affix a sticker to the fabric panel where the stickers can stay secured in place during normal use, but can be removed as desired without tearing or leaving an adhesive residue on the second panel.

Generally, a user can personalize the customizable backpack to their liking. For instance, the user can customize the panels with objects showing off their school, favorite sports team, favorite band, favorite character, corporate designs or logos, etc. In some embodiments, the panels can be embroidered with a design, phrase, or pattern.

To couple the first panel to the pack body, proximate a top edge of the panel, one or more fastening mechanisms can be provided. The first panel fastening mechanisms can be implemented to mate with complimentary fastening mechanisms provided on a flap of the backpack. In another embodiment, the first panel fastening mechanisms can correspond to complimentary fastening mechanisms located directly on the backpack. The backpack fastening mechanisms can generally be located proximate a top back side of the backpack. By joining the complimentary fastening mechanisms of the first panel and the backpack, the first panel can be removably secured to the backpack. In some instances, the first panel can be secured to the backpack with the first side facing outwardly, and then removed and flipped over such that the second side is facing outwardly, and secured again to the backpack.

Terminology

The terms and phrases as indicated in quotation marks (“ ”) in this section are intended to have the meaning ascribed to them in this Terminology section applied to them throughout this document, including in the claims, unless clearly indicated otherwise in context. Further, as applicable, the stated definitions are to apply, regardless of the word or phrase's case, to the singular and plural variations of the defined word or phrase.

The term “or” as used in this specification and the appended claims is not meant to be exclusive; rather the term is inclusive, meaning either or both.

References in the specification to “one embodiment”, “an embodiment”, “another embodiment, “a preferred embodiment”, “an alternative embodiment”, “one variation”, “a variation” and similar phrases mean that a particular feature, structure, or characteristic described in connection with the embodiment or variation, is included in at least an embodiment or variation of the invention. The phrase “in one embodiment”, “in one variation” or similar phrases, as used in various places in the specification, are not necessarily meant to refer to the same embodiment or the same variation.

The term “couple” or “coupled” as used in this specification and appended claims refers to an indirect or direct physical connection between the identified elements, components, or objects. Often the manner of the coupling will be related specifically to the manner in which the two coupled elements interact.

The term “directly coupled” or “coupled directly,” as used in this specification and appended claims, refers to a physical connection between identified elements, components, or objects, in which no other element, component, or object resides between those identified as being directly coupled.

The term “approximately,” as used in this specification and appended claims, refers to plus or minus 10% of the value given.

The term “about,” as used in this specification and appended claims, refers to plus or minus 20% of the value given.

The terms “generally” and “substantially,” as used in this specification and appended claims, mean mostly, or for the most part.

Directional and/or relationary terms such as, but not limited to, left, right, nadir, apex, top, bottom, vertical, horizontal, back, front and lateral are relative to each other and are dependent on the specific orientation of a applicable element or article, and are used accordingly to aid in the description of the various embodiments and are not necessarily intended to be construed as limiting.

The term “fastening mechanism,” as used in the specification and appended claims, refers to a structure for coupling one or more objects together. Fastening mechanisms can include, but are not limited to, snap fasteners, hook and loop material, buttons, and zip fasteners.

The term “backpack,” as used in the specification and appended claims, refers to a bag having a flap, where the bag is adapted to be worn or carried by a user.

An Embodiment of a Customizable Backpack

Referring to FIG. 1, a detailed diagram of an embodiment 100 showing a customizable backpack is illustrated. Typically, the customizable backpack can be implemented in place of a conventional backpack to allow a user to customize the backpack to their personal style.

Generally, the customizable backpack 100 can include a pack body 102 and a pack panel 104. The pack panel 104 can be adapted to be removably coupled to the pack body 102 proximate a pack flap 106 of the pack body 102. In one embodiment, the pack flap 106 can be an integrated part of the pack body 102. In another embodiment, the pack flap 106 can be removably coupled to the pack body 102 proximate a top, back side of the pack body 102.

Figure 2A:
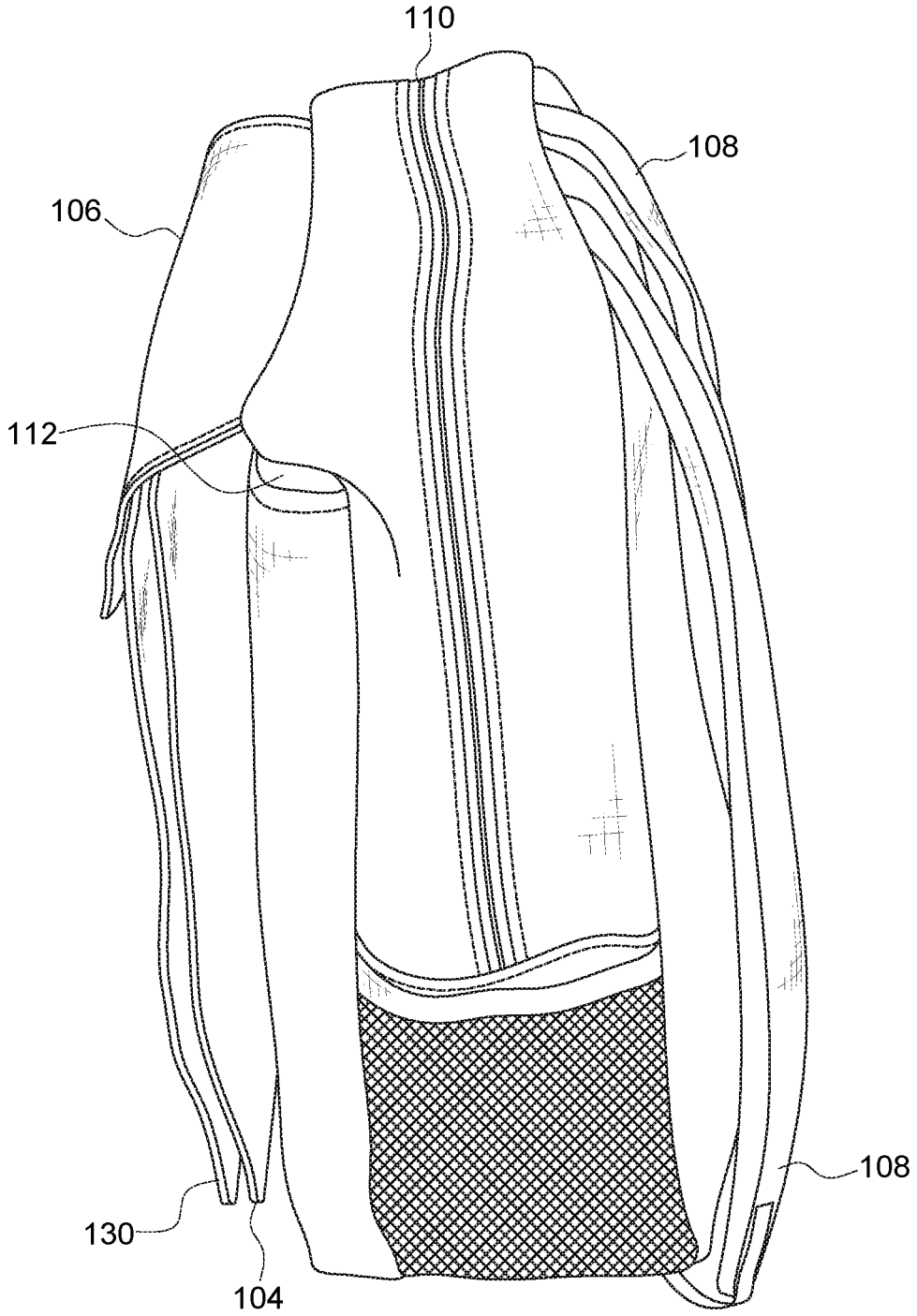
FIG. 2A is a side view a customizable backpack according to one embodiment of the present invention.
Figure 2B:
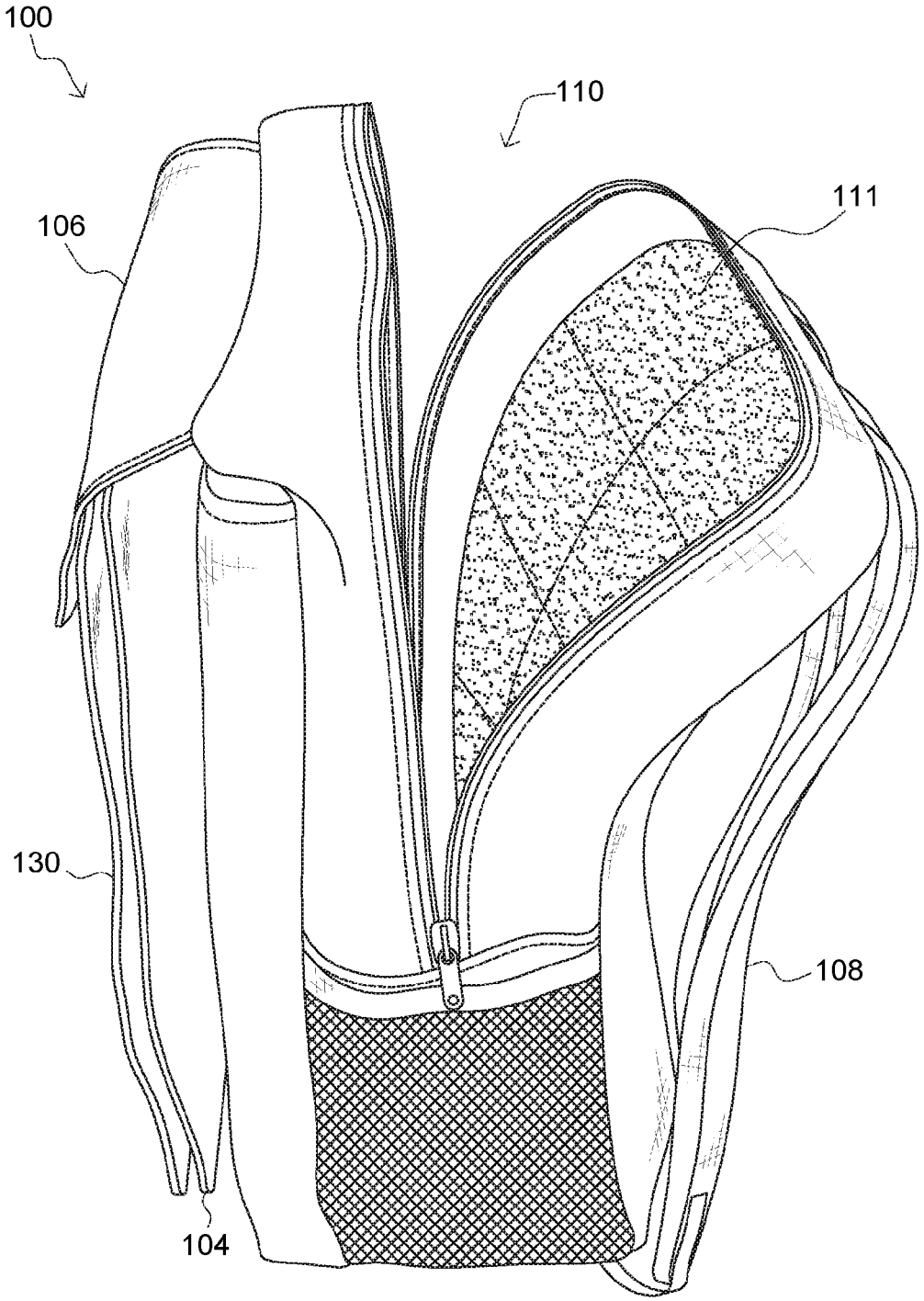
FIG. 2B is a side perspective view a customizable backpack according to one embodiment of the present invention.

As shown in FIGS. 1-2B, the pack body 102 can have a relatively traditional configuration. The pack body 102 can include a pair of shoulder straps 108, a first storage compartment 110, and a second storage compartment 112. The first storage compartment 110 can be substantially similar to any zippered storage compartment of a conventional backpack. In one embodiment, an interior wall of the first storage compartment 110 can be lined with a fastening mechanism, as shown in FIG. 2B. For instance, the interior wall of the first storage compartment 110 can be covered by loop material 111.

As shown in FIGS. 2A-2B, the second storage compartment 112 can generally be located under the pack flap 106 on an exterior side of the pack body 102. The pack panel 104 can be implemented to cover the second storage compartment 112. In one embodiment, the second storage compartment 112 can be a sleeve-like storage compartment with an open end for receiving objects. It is to be appreciated that the second storage compartment 112 can be closed via a fastening mechanism.

In one embodiment, the pack body 102 can include the pack flap 106 proximate an upper portion of the pack body 102, as shown in FIGS. 2A-2B. Generally, the pack flap 106 can include one or more fastening mechanisms 114 adapted to couple to the pack panel 104, as shown in FIG. 3.

Figure 3:
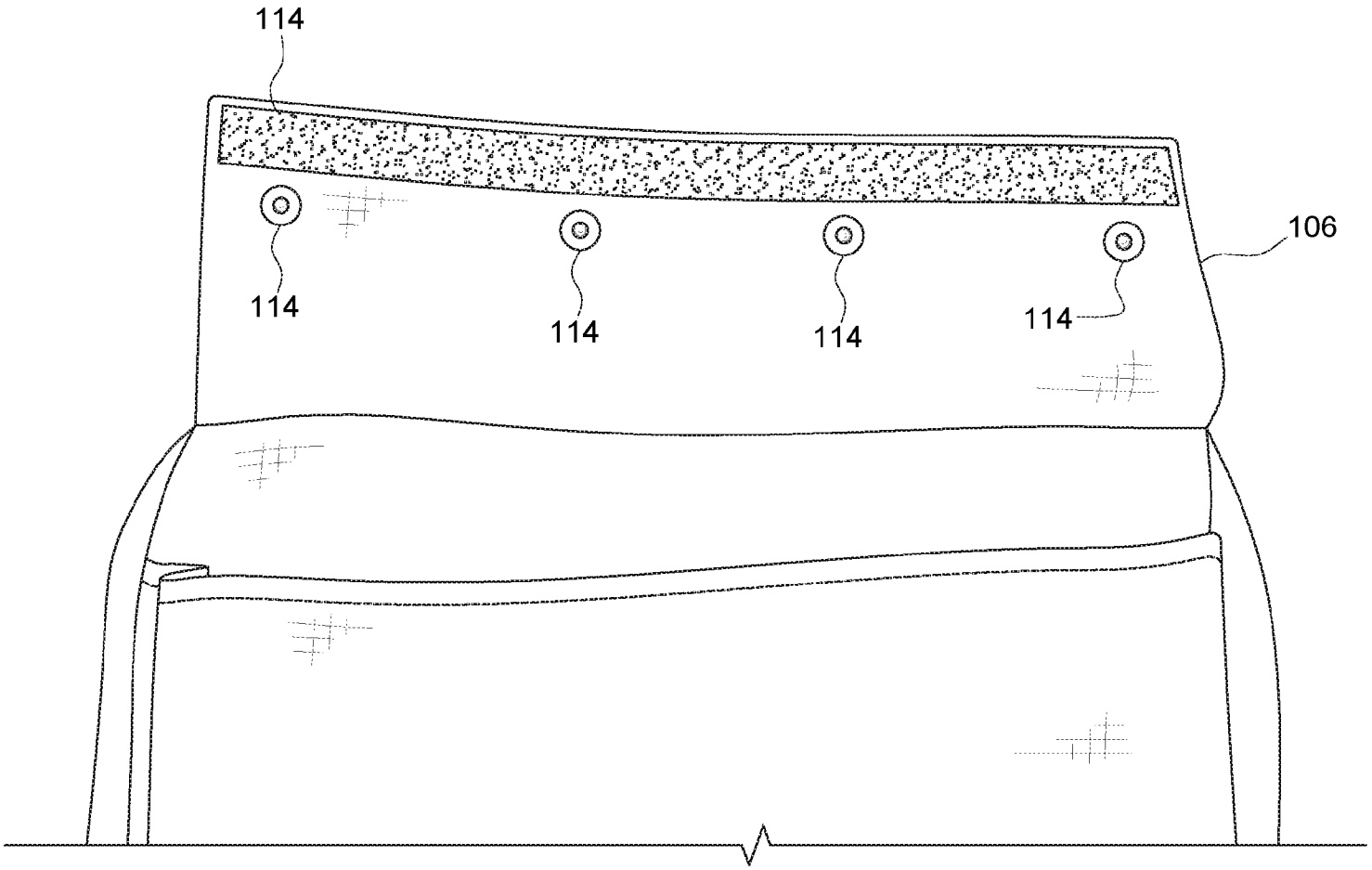
FIG. 3 is close-up view of a pack flap according to one embodiment of the present invention.
Figure 4:
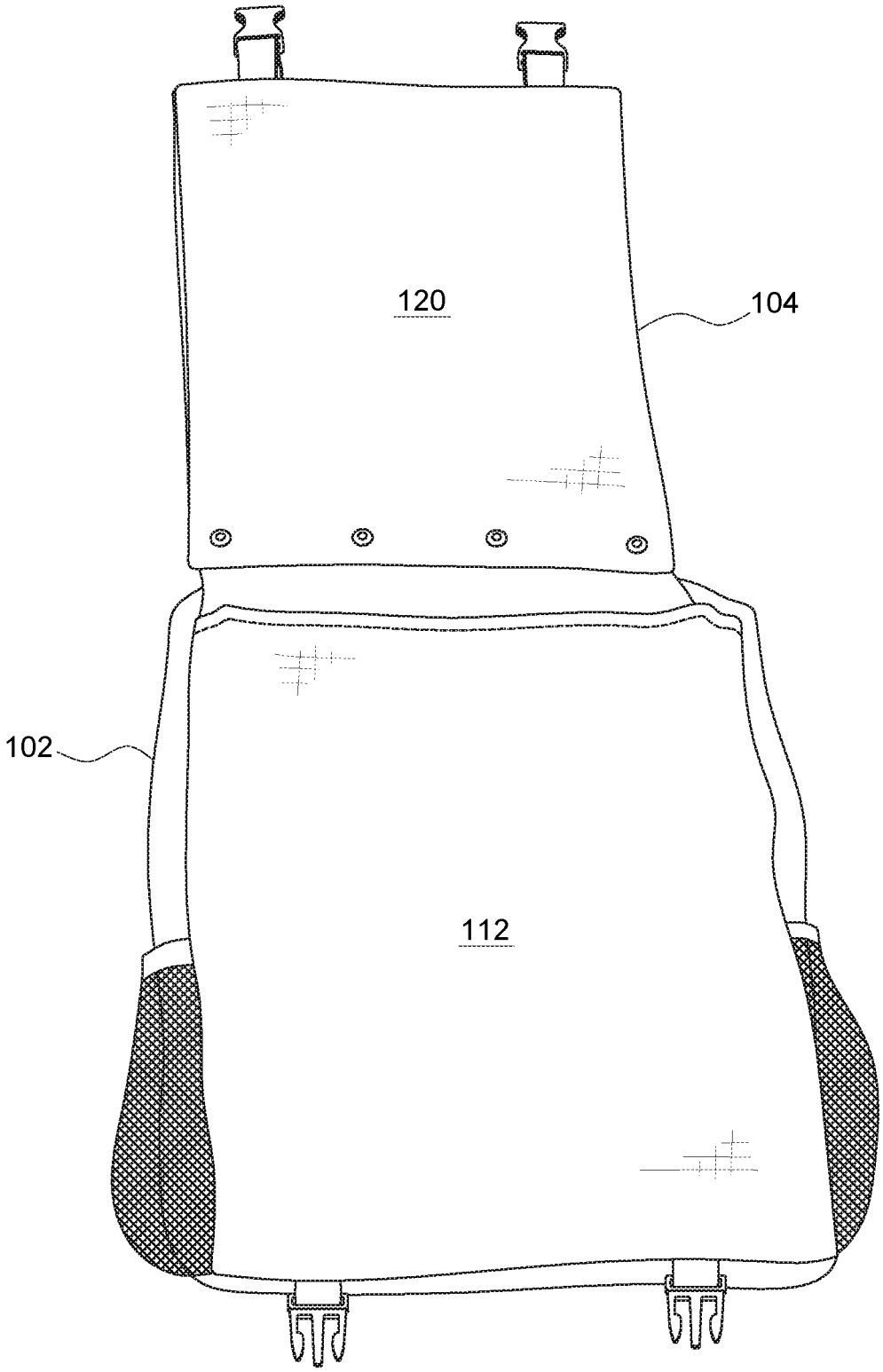
FIG. 4 is a back view of a customizable backpack with a pack panel flipped up according to one embodiment of the present invention.

Referring to FIG. 3, a close up of the one or more fastening mechanisms 114 on the pack flap 106 is illustrated. In one embodiment, the one or more fastening mechanisms 114 can include both snaps and a hook or loop material strip. Generally, the use of both snaps and hook or loop material can help ensure a more secure attachment of the pack panel 104 to the pack flap 106. It is appreciated that other embodiments can implement various other means to secure the pack panel 104 to the pack flap 106. For instance, fastening mechanisms including, but not limited to, buckles, zippers, and buttons can be implemented alone or in combination to couple the pack panel 104 to the pack flap 106.

In one embodiment, the pack panel 104 can be removably coupled to the pack body 102 in place of coupling to the pack flap 106. For instance, the customizable backpack 100 may not include the pack flap 106. In one example, a zipper connection may be implemented to couple the pack panel 104 directly to the pack body 102. The zipper connection may provide a desired flexibility between the pack panel 104 and the pack body 102 to facilitate easy opening and closing of the pack panel 104. For instance, one half of the zipper connection can be coupled to the pack panel 104 and the other half can be coupled to the pack body 102. In another embodiment, a subflap or a flexible section of material may be integrated into a top edge of the pack panel 104 to provide flexibility for opening and closing in place of the pack flap 106. In such an embodiment, the subflap would be removably coupled to both the pack panel 104 and the pack body 102.

Generally, the pack panel 104 can include one or more layers of material. In some embodiments, a stiffer pack panel 104 that remains substantially planar may be desirable. To provide a stiffer pack panel 104, several layers of fabric may be sandwiched and sewn or otherwise joined together. For instance, the pack panel 104 may comprise a piece of nylon fabric sandwiched by two sheets of loop material fabric. In another instance, a piece of plastic may be sandwiched between two sheets of loop material fabric. In yet another instance, padding in the form of foam or fill can be provided to impart both softness and a degree of rigidity to the pack panel 104. In some embodiments, a flexible pack panel 104 may be desirable. Generally, a flexible pack panel 104 may comprise a fabric layer and a loop material fabric layer joined together. As can be appreciated, the construction of the pack panel 104 can vary significantly and substantially without deviating from the inventive aspects of the present invention.

Figure 5:
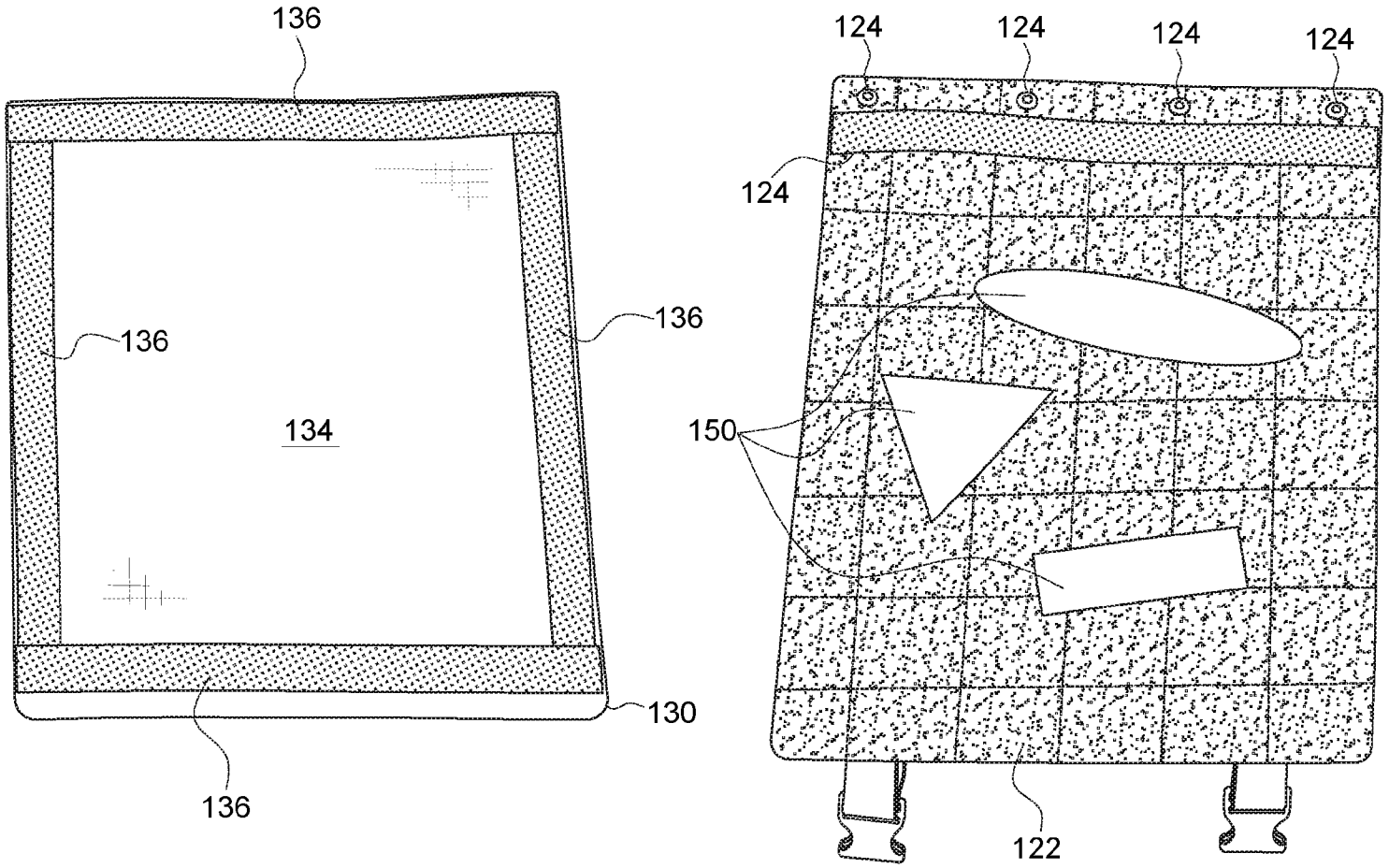
FIG. 5 is a back view of a pack panel and a fabric panel according to one embodiment of the present invention.
Figure 6:
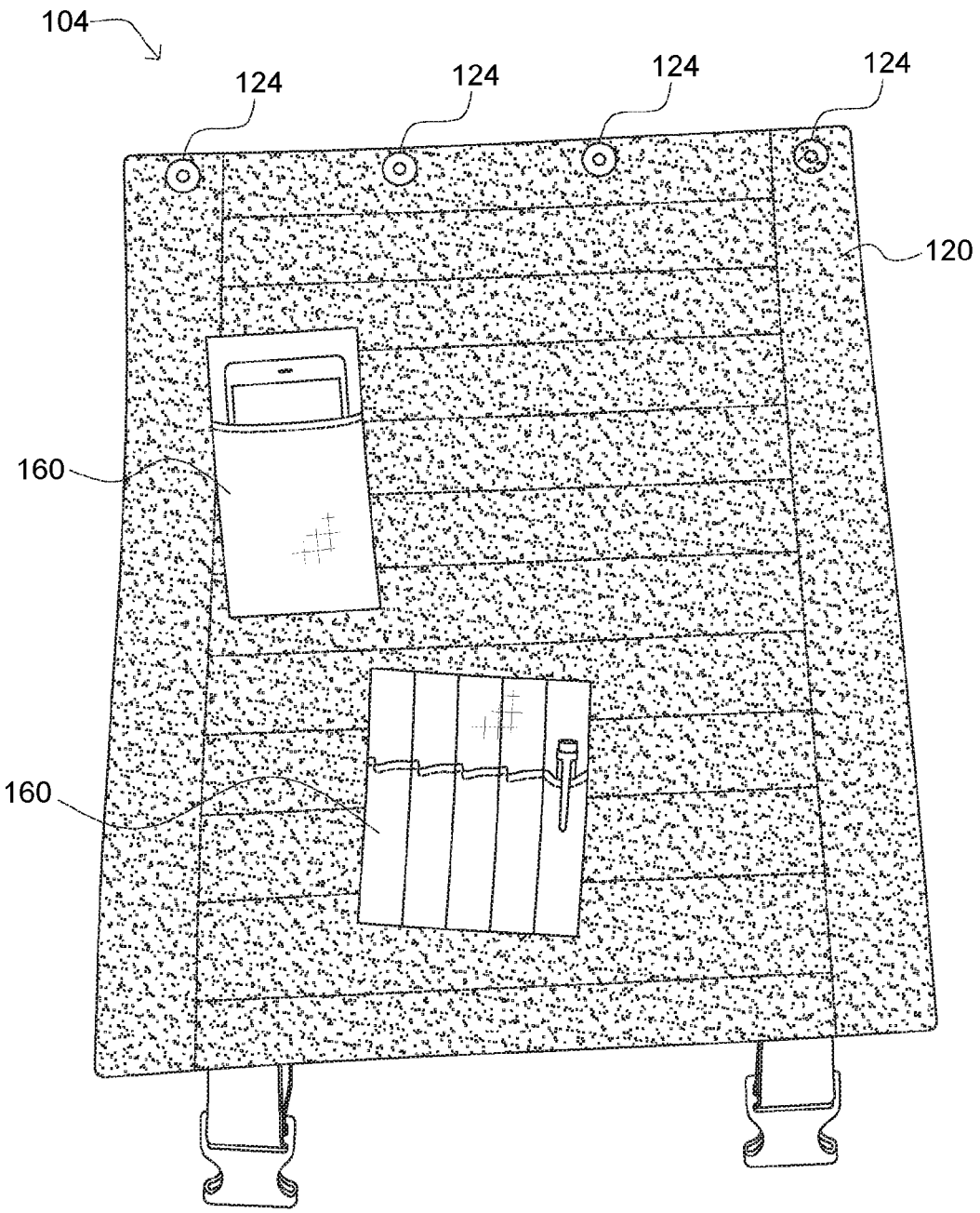
FIG. 6 is a front view of a pack panel according to one embodiment of the present invention.

In a typical embodiment, the pack panel 104 can include a first side 120, shown in FIG. 5, and a second side 122, shown in FIG. 6. Each of the sides 120, 122 can include one or more fastening mechanisms 124 along an upper portion of the pack panel 104, as shown in FIGS. 5 and 6. The one or more fastening mechanisms 124 can be adapted to be complementary to the pack flap fastening mechanisms 114.

In one embodiment, each side 120, 122 of the pack panel 104 can be covered in loop material. Depending on an implementation, each side 120, 122 can be covered in different patterns of loop material. For instance, the first side 120 can include segmented patch of loop material and the second side 122 can include one big patch of loop material. The segmented patch of loop material can be implemented to allow a user to more easily configure one or more decorative pieces geometrically to the pack panel 104.

As shown in FIGS. 1 and 2A-2B, the pack panel 104 can include a removably attachable second panel 130. The second panel 130 can be adapted to removably attach to one side of the pack panel 104. In one embodiment, an outer side 132 of the second panel 130 can include a fabric material and an inner side 134 can typically include a fastening mechanism. The inner side 134 of the second panel 130 is shown in FIG. 5. Generally, the second panel 130 can encompass an entire surface of one of the sides 120, 122 of the pack panel 104. It is to be appreciated that the second panel 130 can be coupled to either side 120, 122 of the pack panel 104.

As shown, the inside surface 134 of the second panel 130 can be removably attached to the pack panel 104. The inside surface 134 of the second panel 130 can include a perimeter of hook material strips 136 to mate and join with the loop surface of either side 120, 122 of the pack panel 104. It is appreciated that many different fabric panels can be provided to attach to the pack panel 104 in a variety of colors and designs permitting a user to customize his/her backpack.

In one variation of the second panel 130, the second panel 130 can be comprised of a polyester fabric that permits a user to affix one or more decorative objects 150 to the polyester fabric such that the decorative objects 150 stay secured in place during normal use but can be removed as desired without tearing or leaving an adhesive residue on the second panel 130 when removed. For instance, a reusable adhesive can be implemented to secure the decorative objects 150 to the second panel 130.

As shown in FIGS. 1 and 5, the one or more decorative objects 150 can be affixed to the second side of the first panel 104 and the first side 132 of the second panel 130. The decorative objects 150 can include, but are not limited to, fabric sheets having graphical elements, plastic sheets having graphical elements, patches, badges, and stickers. Typically, the decorative objects 150 can be arranged on the first side 132 of the second panel and on either side 120, 122 of the pack panel 104. The decorative objects 150 can be arranged to create a collage as desired and arranged by a user.

Typically, decorative objects 150 to be attached to the second panel 130 can include an adhesive and decorative objects to be attached to the pack panel 104 can include a strip of hook material. It is to be appreciated that other means of attaching the decorative objects 150 to the panels 104, 130 is contemplated.

As shown in FIG. 6, one or more utilitarian objects 160 can be attached to the first side 120 and/or the second side 122 of the pack panel 104. Generally, the utilitarian objects 160 can include, but are not limited to, a cell phone pocket, a pencil/pen holder, a tablet case, a headphones pocket, a pocket, a reflector, a dry erase board, and a toy holder. It is to be appreciated that the first side 120 and the second side 122 of the pack panel can allow a user to affix design and/or utility objects having complimentary hook elements to the loop material of pack panel 104. Further, the utilitarian objects 160 can be attached to the loop material 111 on the interior wall of the first storage compartment 110. For instance, a tablet sleeve can be attached to the loop material 111 to safely store a tablet in an interior of the first storage compartment 110.

An Example Implementation of a Customizable Backpack

In an example implementation of the customizable backpack, a user can wear the backpack with the second panel attached to the first panel and facing outwardly, the second panel attached to the first panel with the first panel facing outwardly, the first side of the first panel facing outwardly, and the second side of the first panel facing outwardly. Generally, the customizable backpack can be implemented to project how the user is feeling by offering the user a plurality of options on how to decorate the backpack. For instance, if a big sports game is approaching, the user may decorate the first panel 104 and the second panel 130 with one or more decorative objects 150 displaying graphical elements supporting a team of the user.

In a first step, a user can decorate each of the panels 104, 130 with various decorative objects and utilitarian objects. Generally, the user can select decorative objects that are related to interests of the user. Depending on what the user will plan on carrying with the backpack, one or more utilitarian objects can be attached to the panels 104, 130.

In a second step, the user can determine which of the panels 104, 130 will be facing outwardly and be displayed when wearing the backpack 100.

In a third step, after the user has determined which of the panels 104, 130 will be facing outwardly, the user can attach the pack panel 104 to the pack flap 106. If the second panel 130 will be facing outwardly, the user can attach the second panel 130 to the pack panel 104 before the pack panel 104 is coupled to the pack flap 106. It is to be appreciated that the second panel 130 can be attached to the pack panel 104 after the pack panel 104 has been coupled to the pack flap 106.

In a fourth step, the user can wear the backpack with the selected panel facing outwardly. In some instances, the user may add one or more decorative objects or utilitarian objects to the panel facing outwardly.

In a fifth step, the user can detach the pack panel 104 from the pack flap 106 and attach the pack panel 104 to the pack flap 106 with a different panel facing outwardly.

Typically, the user can continuously rearrange the panels 104, 130 depending on how the user is feeling. The user can also continuously update and modify each of the panels with different decorative objects and utilitarian objects.

Alternative Embodiments and Variations

Embodiments of the present invention are contemplated where the backpack is substituted for a messenger bag or a diaper bag. Generally, embodiments of the present invention can be implemented with a bag having a flap.

The various embodiments and variations thereof, illustrated in the accompanying Figures and/or described above, are merely exemplary and are not meant to limit the scope of the invention. It is to be appreciated that numerous other variations of the invention have been contemplated, as would be obvious to one of ordinary skill in the art, given the benefit of this disclosure. All variations of the invention that read upon appended claims are intended and contemplated to be within the scope of the invention.

I claim:

1. A customizable backpack comprising:

a pack body having at least one storage compartment, at least one strap adapted to be worn on a shoulder, and a flap;

a first panel attached to the pack body proximate the flap, the first panel including:

a plurality of sheets of fabric forming the first panel;

at least one of the sheets of fabric forming an exterior surface of the first panel being loop material;

one or more fastening mechanisms located on both sides of the first panel proximate an upper portion of the first panel, the one or more fastening mechanisms adapted to couple to complementary fastening mechanisms on the flap;

a second panel adapted to removably couple to the first panel;

a first decorative object including a hook material patch, the first decorative object adapted to couple to the loop material of the first panel; and a second decorative object including an adhesive, the second decorative object adapted to removably couple to the second panel.

2. The customizable backpack of claim 1, wherein (i) the second panel includes a plurality of sheets of fabric forming the second panel, and (ii) at least one of the sheets of fabric forming an exterior surface of the second panel is a woven fabric.

3. The customizable backpack of claim 1, wherein the pack body includes at least two straps each adapted to be worn on a shoulder.

4. The customizable backpack of claim 1, wherein the second panel comprises polyester fabric.

5. A customizable backpack comprising:

a pack body having at least one storage compartment, at least one strap adapted to be worn on a shoulder, and a flap;

a first panel removably attached to the pack body proximate the flap, the first panel including:

a plurality of sheets of fabric forming the first panel;

at least one of the sheets of fabric forming an exterior surface of the first panel being loop material;

one or more fastening mechanisms located on both sides of the first panel proximate an upper portion of the first panel, the one or more fastening mechanisms adapted to couple to complementary fastening mechanisms on the flap; and a second panel adapted to removably couple to the first panel.

6. The customizable backpack of claim 5, wherein (i) the second panel includes a plurality of sheets of fabric forming the second panel, and (ii) at least one of the sheets of fabric forming an exterior surface of the second panel is a woven fabric.

7. The customizable backpack of claim 5, wherein the pack body includes at least two straps each adapted to be worn on a shoulder.

8. The customizable backpack of claim 5, wherein the second panel comprises polyester fabric.

9. A customizable backpack comprising:

a pack body having at least one storage compartment and a pair of shoulder straps;

a first panel removably attached to the pack body, the first panel having (i) at least one exterior surface being loop material, (ii) a first one or more fastening mechanisms located on a first side of the first panel proximate an upper portion of the first panel, and (iii) a second one or more fastening mechanisms located on a second side of the first panel proximate the upper portion of the first panel; and a second panel adapted to removably couple to the first panel;

wherein the first one or more fastening mechanisms on the first side and the second one or more fastening mechanisms on the second side are each adapted to couple to complementary fastening mechanisms on the pack body.

* * * * *